US006544021B2

(12) United States Patent
Watanabe et al.

(10) Patent No.: US 6,544,021 B2
(45) Date of Patent: Apr. 8, 2003

(54) OIL PUMP

(75) Inventors: Yasushi Watanabe, Kanagawa (JP); Hideaki Ohnishi, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/951,500

(22) Filed: Sep. 14, 2001

(65) Prior Publication Data

US 2002/0054822 A1 May 9, 2002

(30) Foreign Application Priority Data

Nov. 9, 2000 (JP) ..... 2000-341375

(51) Int. Cl.[7] ..... F04C 18/00
(52) U.S. Cl. ..... 418/171; 418/189
(58) Field of Search ..... 418/171, 189

(56) References Cited

U.S. PATENT DOCUMENTS 3,635,604 A * 1/1972 Petersen et al. ..... 418/171
4,767,296 A 8/1988 Satomoto et al.
5,145,347 A * 9/1992 Freeman ..... 418/171
6,120,256 A 9/2000 Miyazawa

FOREIGN PATENT DOCUMENTS

GB 1271677 * 4/1972 ..... 418/171
JP 04-005476 * 1/1992 ..... 418/171

* cited by examiner

*Primary Examiner*—Thomas Denion
*Assistant Examiner*—Theresa Trieu
(74) *Attorney, Agent, or Firm*—Foley & Lardner

(57) ABSTRACT

An oil pump includes suction and discharge chambers formed in a sidewall of a housing, and a maximum-volume-side partition area formed with the sidewall of the housing on a trajectory of pump houses and at a position where each pump house has a maximum volume, wherein the maximum-volume-side partition area creates a section where any pump house spreads over neither of the suction and discharge chambers. A plurality of channels is arranged in the discharge chamber at an end thereof, each channel having a predetermined length and extending to the maximum-volume-side partition area.

14 Claims, 7 Drawing Sheets

OIL PUMP

BACKGROUND OF THE INVENTION

The present invention relates to oil pumps for use in motor vehicles to supply lubricating oil, drive hydraulic actuators, etc.

U.S. Pat. No. 4,767,296 discloses an oil pump for supplying lubricating oil in motor vehicles. This oil pump is of the trochoidal type including an inner rotor and an outer rotor eccentrically disposed at the outer periphery thereof, wherein trochoid-curve-based external teeth and internal teeth are formed on an outer peripheral surface of the inner rotor and an inner peripheral surface of the outer rotor, respectively. The number of internal teeth of the outer rotor is larger by one than that of the external teeth of the inner rotor. A plurality of pump houses defined between the internal and external teeth is urged to move circumferentially with rotation of the inner rotor for variation in volume of each pump house.

The above trochoidal oil pump raises no problem such as noise, vibration and wear at high-speed rotation, but produces a great loss of driving horsepower at low/medium-speed rotation for the reason as described later.

SUMMARY OF THE INVENTION

It is, therefore, an object of the present invention to provide oil pumps for use in motor vehicles, which allow a restraint in noise, vibration and wear at high-speed rotation and a reduction in consumed horsepower at low/medium-speed rotation.

The present invention provides generally an oil pump, comprising:

a housing;

a pump portion accommodated in the housing, the pump portion being rotated with both sides closed by sidewalls of the housing, the pump portion including a plurality of pump houses arranged circumferentially, the pump houses being urged to move in a direction of rotation for variation in a volume thereof;

suction and discharge chambers formed in the sidewall of the housing, the suction and discharge chambers facing suction and discharge areas of the pump portion, respectively;

a maximum-volume-side partition area formed with the sidewall of the housing on a trajectory of the pump houses and at a position where each pump house has a maximum volume, wherein the maximum-volume-side partition area creates a section where any pump house fails to spread over either of the suction and discharge chambers; and a plurality of channels arranged in the discharge chamber at an end thereof, each channel having a predetermined length and extending to the maximum-volume-side partition area.

BRIEF DESCRIPTION OF THE DRAWINGS

The other objects and features of the present invention will become apparent from the following description with reference to the accompanying drawings, wherein.

DETAILED DESCRIPTION OF THE INVENTION

In the trochoidal oil pump disclosed in U.S. Pat. No. 4,767,296, a side of the inner and outer rotors is closed by a stationary sidewall of a housing. Suction and discharge chambers are formed in the sidewall to open in suction and discharge areas between the two rotors. The sidewall has a maximum-volume-side partition area and a minimum-volume-side partition area arranged on a trajectory of the pump houses and in the vicinity of a position where the pump house has a maximum volume and a position where it has a minimum volume, respectively. Each of the maximum-volume-side and minimum-volume-side partition areas serves to create a section where pump house spreads over neither of the suction and discharge chambers. A thin channel is formed at an end of the discharge chamber toward the maximum-volume-side partition area. The thin channel has a small section relative to a general part of the discharge chamber, and extends for a predetermined length.

Figure 9:
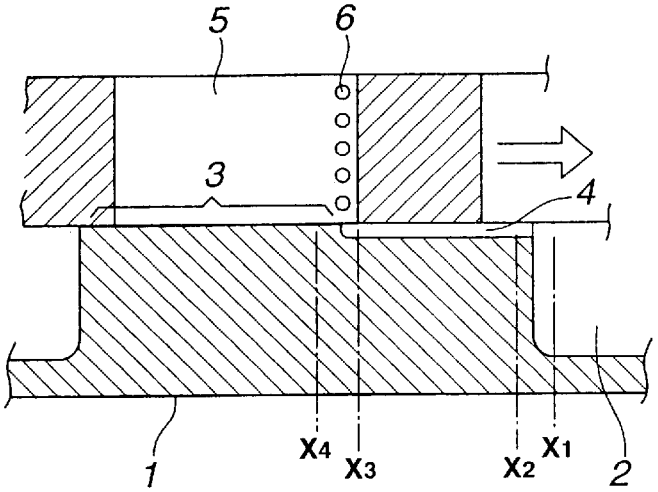
PRIOR ART FIG.9
FIG. 9 is a view similar to FIG. 6, explaining a problem in a conventional oil pump.
Figure 10:
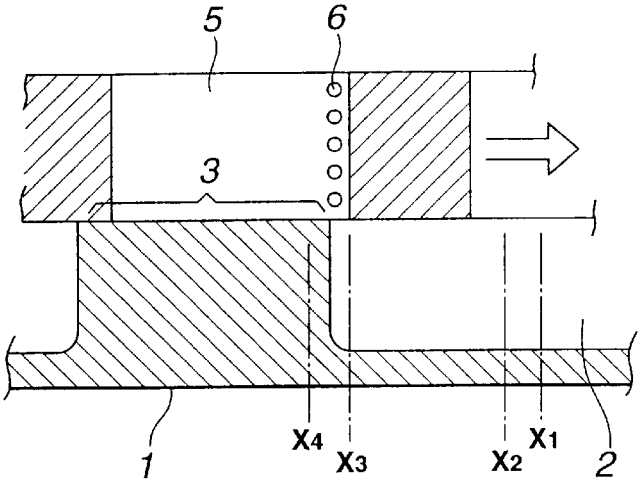
PRIOR ART FIG.10
FIG. 10 is a view similar to FIG. 9, explaining a problem in another conventional oil pump.
Figure 11:
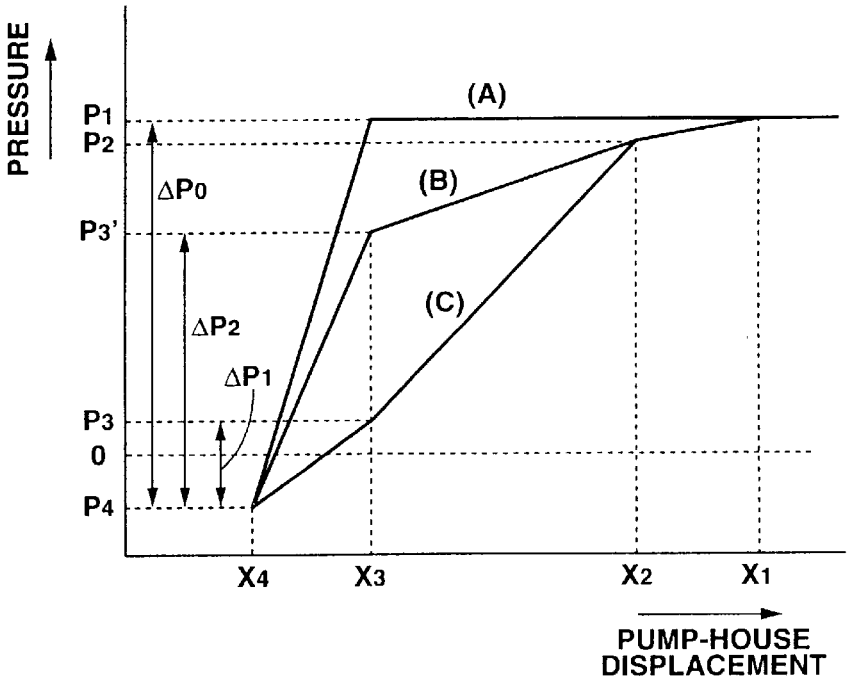
FIG. 11 is a graphical representation illustrating pressure vs. pump-house displacement characteristics of the oil pump of the present invention and the conventional oil pup.

Referring to FIGS. 9–11, since the oil pump has thin channel 4 with a small section and a predetermined length formed at the end of discharge chamber 2 of sidewall 1 toward maximum-volume-side partition area 3, a pressure $P_3$ at a tip of thin channel 4 is reduced with respect to a pressure $P_1$ within the general part of discharge chamber 2. This allows a restraint in abrupt pressure introduction from discharge chamber 2 to pump house 5 at high-speed rotation of the pump, preventing occurrence of noise, vibration, and wear.

Specifically, at high-speed rotation of the pump, pump house 5 falls in negative pressure in maximum-volume-side partition area 3. As a consequence, the pressure within pump house 5 is lower than the pressure within discharge chamber 2, and the cavitation occurs in pump house 5 to produce bubbles 6. Referring to FIG. 9, suppose that a predetermined position in the general part of discharge chamber 2 adjacent to a base end of thin channel 4 is $X_1$, predetermined positions at the base end and the tip of thin channel 4 are $X_2$, $X_3$, and a predetermined position in maximum-volume-side partition area 3 adjacent to the tip of thin channel 4 is $X_4$. Referring to FIG. 10, when no thin channel 4 is formed in discharge chamber 2, the pressures at the positions $X_2$, $X_3$ are equal to pressure $P_1$ at the position $X_1$, a pressure difference $\Delta P_o$ at the instant when pump house 5 opens in discharge chamber 2 is a difference $P_1-P_4$ between pressure $P_1$ at the general part and pressure $P_4$ at maximum-volume-side partition area 3. In this connection, refer to a characteristic (A) in FIG. 11.

On the other hand, in the oil pump as shown in FIG. 9, a pressure $P_2$ at the base end of thin channel 4 or position $X_2$ is lower than pressure $P_1$ at the general part of discharge chamber 2 or position $X_1$. And pressure $P_3$ at the tip of thin channel 4 or position $X_3$ is further lower than pressure $P_2$, so that a pressure difference $\Delta P_1=P_3-P_4$ at the instant when pump house 5 opens in discharge chamber 2 or thin channel 4 is lowered by a pressure reduction in thin channel 4. In this connection, refer to a characteristic (C) in FIG. 11. Therefore, in this pump, an abrupt pressure variation in discharge chamber 2 at the instant when pump house 5 opens in discharge chamber 2 or thin channel 4 does not occur, resulting in no occurrence of noise, vibration, etc. due to cavitation bubbles 6 in pump house 5 abruptly crushed by the pressure variation.

The oil pump as shown in FIG. 9 is free of noise, vibration, etc. at high-speed rotation due to arrangement of thin channel 4. However, at low/medium-speed rotation, while pump house 5 is urged to move from maximum-volume-side partition area 3 to discharge chamber 2, thin channel 4 acts as a restrictor for oil flowing from pump house 5 to discharge chamber 2, increasing the pressure within pump house 5, leading to a great loss of horsepower of the pump.

Figure 12:
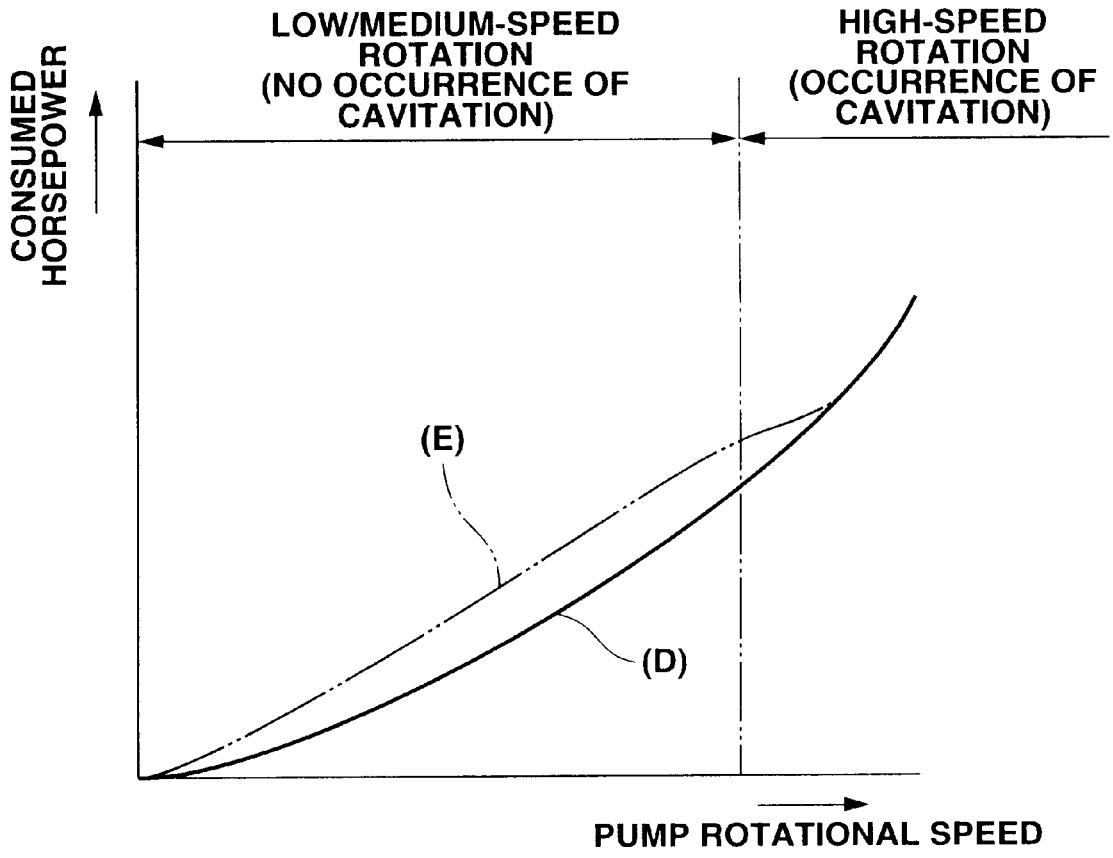
FIG. 12 is a graphical representation similar to FIG. 11, illustrating consumed horsepower vs. pump rotational speed characteristics of the oil pump of the present invention and the conventional oil pup.

Specifically, at low/medium-speed rotation of the pump, pump house 5 does not fall in negative pressure at maximum-volume-side partition area 3. Here, when pump house 5 is urged to move from maximum-volume-side partition area 3 to discharge chamber 2, the flow rate of oil discharged from pump house 5 to discharge chamber 2 is restricted by thin channel 4 to increase the pressure within pump chamber 5, which forms a resistance to pump rotation. Therefore, referring to FIG. 12, with no arrangement of thin channel 4, consumed horsepower should vary roughly linearly with a rise in pump rotational speed as illustrated by a characteristic (D), whereas with arrangement of thin channel 4, consumed horsepower at low/medium-speed rotation rises in its entirety as illustrated by a characteristic (E) with respect to characteristic (D).

An increase in consumed horsepower at low/medium-speed rotation of the pump can be cancelled by enlarging the sectional area of thin channel 4. However, enlargement of the sectional area of thin channel 4 causes lowering of a pressure-reduction effect of thin channel 4 at high-speed rotation of the pump as illustrated by a characteristic (B) in FIG. 11, leading to increased possibility of occurrence of noise, vibration, and wear. It is thus desired to solve two conflicting problems at the same time.

Referring to FIGS. 1–4, an oil pump for motor vehicles embodying the present invention is of the inscribed trochoidal type, and comprises a housing 10 directly secured to a front end face of an engine block or integrally mounted to an engine front cover. Housing 10 comprises a main body and a cover, though FIGS. 1–4 show only the main body with cover removed.

Housing 10 is formed out of aluminum material as a whole, and has a roughly circular concavity 11 for rotatably accommodating a pump main body or pump portion, and suction and discharge chambers 12, 13 formed in opposite positions on the circumference of concavity 11 to extend roughly circularly. Suction and discharge chambers 12, 13 are arranged in an inner wall of the main body of housing 10 behind concavity 11 as viewed, e.g. in FIG. 1. Suction and discharge chambers 12 are also arranged in an inner wall of the cover, not shown, in the same way to correspond to those of the main body. Moreover, suction and discharge chambers 12 are connected to suction and discharge ports 14, 15 of housing 10, respectively, through which oil is supplied and discharged to the outside. In the illustrative embodiment, stationary sidewalls for closing both sides of the pump main body comprise the inner wall of the main body of housing 10 and the inner wall of the cover thereof.

Concavity 11 of housing 10 accommodates in an eccentric way an inner rotor 17 with external teeth 16 and an outer rotor 19 with internal teeth 18 whose number is larger by one than that of external teeth 16. Inner and outer rotors 17, 19 are formed out of sintered metal, and include a trochoid-curve-based tooth flank. In the meshed state, two rotors 17, 19 cooperate to each other to define a plurality of pump houses 20 between the tooth flanks of the two.

Inner rotor 17 at the inner periphery is coupled with an engine crankshaft, not shown, which acts as a driving shaft for inner rotor 17. Outer rotor 19 is driven by rotation of inner rotor 17 to circumferentially move pump houses 20 in their entirety for variation in volume of each pump house 20. Pump houses 20 communicate with suction chamber 12 in a suction area where the volume of each pump house increases, and discharge chamber 13 in a discharge area where the volume decreases.

Figure 1:
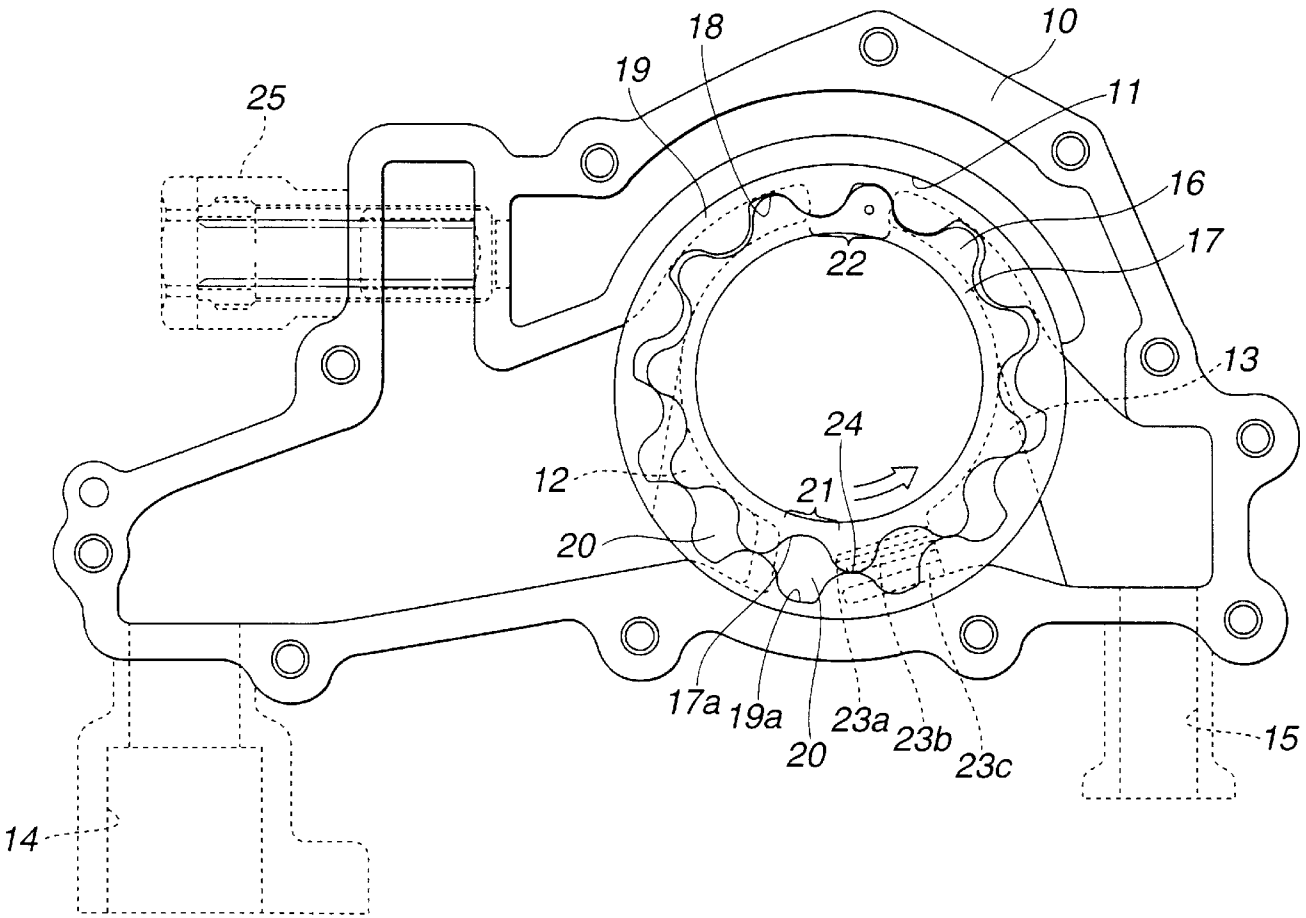
FIG. 1 is a front view showing an embodiment of an oil pump with a cover removed according to the present invention.

As best seen in FIG. 1, a maximum-volume-side partition area 21 and a minimum-volume-side partition area 22 are arranged at the bottom of concavity 11 on a trajectory of pump houses 20 and in the vicinity of a position where pump house has a maximum volume and a position where it has a minimum volume. Areas 21, 22 are formed so that pump house 20 spreads over neither of suction and discharge chambers 12, 13 during pump rotation.

Figure 2:
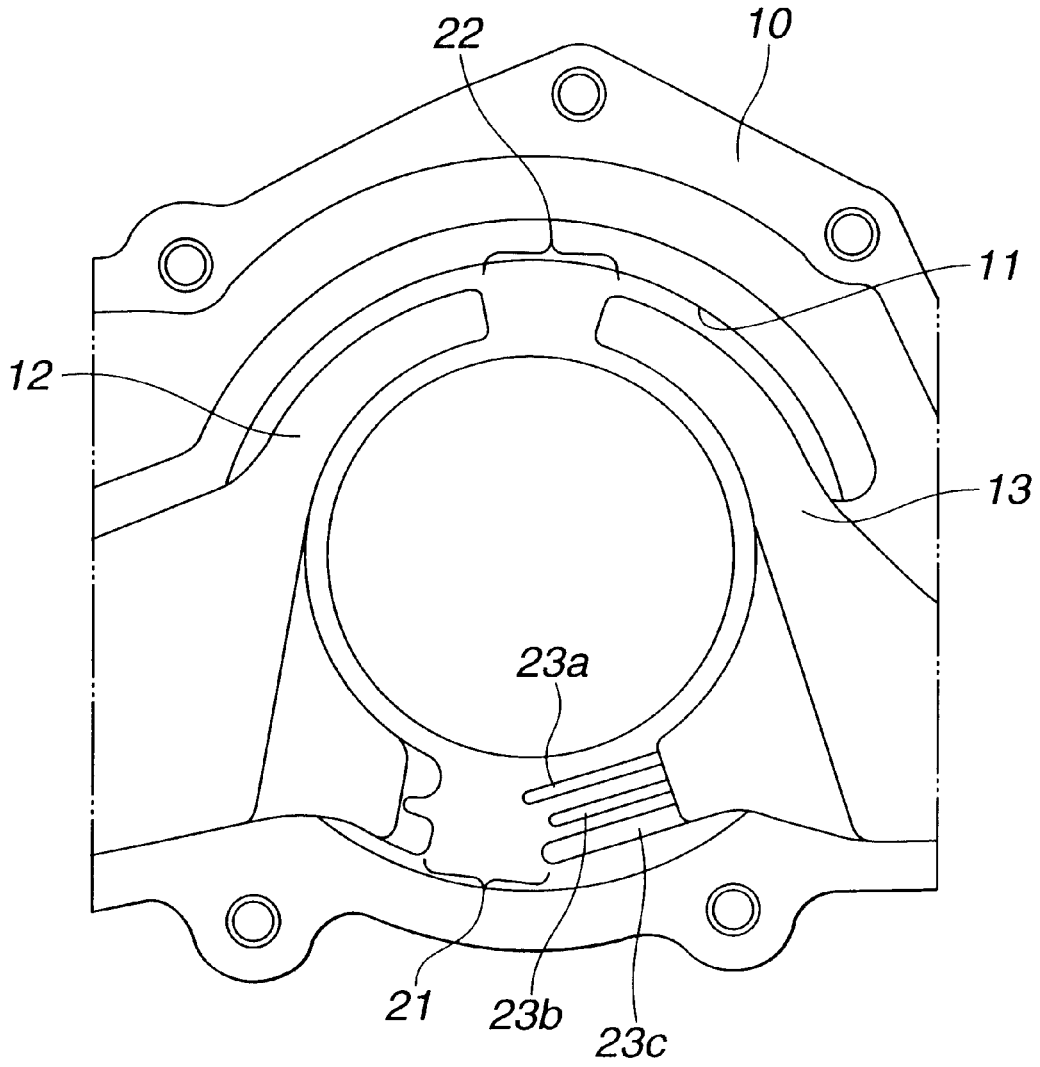
FIG. 2 is an enlarged front view showing the oil pump with cover removed.
Figure 4:
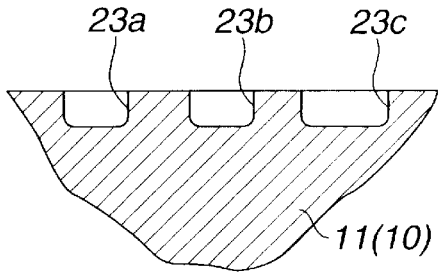
FIG. 4 is a sectional view taken along the line IV—IV in FIG. 3.
Figure 5:
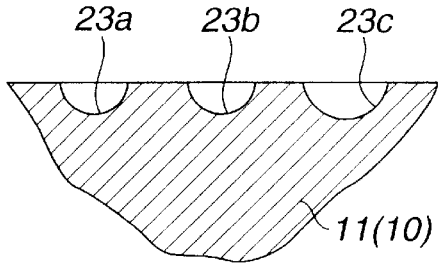
FIG. 5 is a view similar to FIG. 4, showing a variation of the embodiment.
Figure 6:
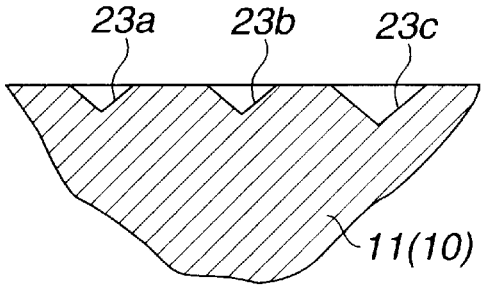
FIG. 6 is a view similar to FIG. 5, showing another variation of the embodiment.

As best seen in FIG. 2, three channels 23*a*, 23*b*, 23*c* each having a predetermined length are formed at an end of discharge chamber 13 on the side of maximum-volume-side partition area 21 to extend to the area 21. Referring to FIGS. 4–6, each channel 23*a*, 23*b*, 23*c* is of a given sectional shape, such as rectangle, semicircle or triangle, having a sufficiently small area with respect to discharge chamber 13. In the illustrative embodiment, the shape of channel 23*a*, 23*b*, 23*c* is linear when viewed from above.

Figure 3:
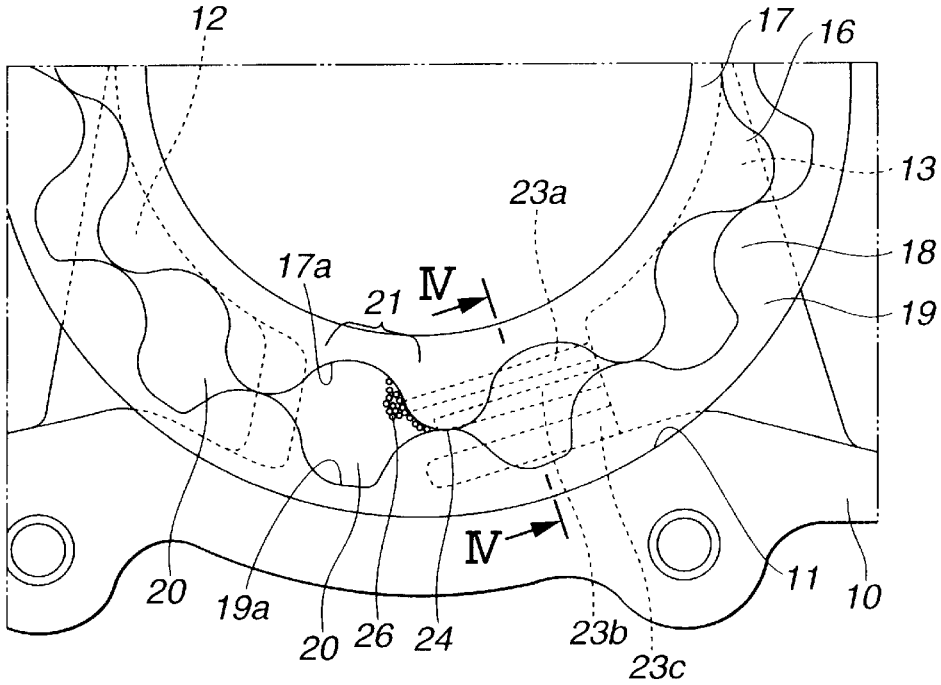
FIG. 3 is a fragmentary enlarged front view showing the oil pump in FIG. 1.

As shown in FIG. 3, center channel 23*b* extends to a position in maximum-volume-side partition area 21, into which a contact 24 of inner and outer rotors 17, 19 in the vicinity of tooth tips thereof is urged to move with pump rotation. Radially inside and outside channels 23*a*, 23*c* extend to a position in maximum-volume-side partition area 21, into which the vicinity of a tooth bottom 17*a* of inner rotor 17 is urged to move and a position into which the vicinity of a tooth bottom 19*a* of outer rotor 19 is urged to move, respectively. Radially inside channel 23*a* and center channel 23*b* are smaller in sectional area than radially outside channel 23*c*. In the illustrative embodiment, channels 23*a*, 23*b*, 23*c* are formed in housing 10 by means of aluminum die-casting. Optionally, channels can be obtained by means of machining of housing 10.

Referring to FIG. 1, a regulator valve 25 is arranged to control the pressure of oil discharged to discharge chamber 13.

With the above structure, when rotating inner rotor 17 with engine start, pump houses 20 are urged to move circumferentially for variation in the volume thereof, feeding oil within suction chamber 12 to discharge chamber 13.

When passing in maximum-volume-side partition area 21, pump house 20 is in no communication with suction and discharge chambers 12, 13 to fall in the temporary hermetic state. At high-speed rotation of the pump, sufficient oil suction cannot be secured with respect to pump rotation, bringing pump house 20 into the negative-pressure state. Thus, at that time, bubbles 26 are often produced in pump house 20 due to cavitation as shown in FIG. 3, which will stay at a forward and radially inside area in pump house 20, i.e. a spot extending from contact 24 of inner and outer rotors 17, 19 in the vicinity of tooth tips thereof to tooth bottom 17*a* of inner rotor 17 due to centrifugal force and inertia force caused by pump rotation.

In that state, when pump house 20 is urged to move to discharge chamber 13, it opens first in the tips of channels 23*a*, 23*b*, 23*c*, which is progressively moved to the base end thereof. Finally, pump house 20 opens directly in a general part of discharge chamber 13.

When pump house 20 opens first at the tips of channels 23*a*, 23*b*, 23*c*, the pressure within discharge chamber 13 is introduced into pump house 20 through the tips of channels 23*a*, 23*b*, 23*c*. At that time, the pressures at the tips of channels 23*a*, 23*b*, 23*c* are not equal to the pressure within discharge chamber 13, but are sufficiently reduced by flow resistances of channels 23*a*, 23*b*, 23*c*. Therefore, at the instant when pump house 20 communicates with channels 23*a*, 23*b*, 23*c*, sufficiently reduced pressure is introduced into pump house 20, so that bubbles 26 resulting from cavitation will disappear naturally without being crushed abruptly.

In the illustrative embodiment, particularly, since two channels 23*a*, 23*b* communicate with pump houses 20 at a spot extending from contact 24 of inner and outer rotors 17, 19 in the vicinity of tooth tips thereof to tooth bottom 17*a* of inner rotor 17, bubbles 26 staying at that spot can be made to disappear efficiently. Moreover, since two channels 23*a*, 23*b* are smaller in sectional area than channel 23*c*, the pressure directly acting on the spot at which bubbles 26 stay can be reduced sufficiently. This results in sure prevention of noise, vibration, and wear produced by abrupt crush of bubbles 26.

On the other hand, at low/medium-speed rotation of the pump, pump house 20 can obtain sufficient oil suction and thus falls in positive pressure in maximum-volume-side partition area 21. With development of rotation, the pressure within pump house 20 tends to be larger than the pressure within discharge chamber 12. In that state, when pump 20 opens in channels 23*a*, 23*b*, 23*c*, oil within pump house 20 is discharged to discharge chamber 13 though channels 23*a*, 23*b*, 23*c*. At that time, the total opening area of channels 23*a*, 23*b*, 23*c* is sufficiently large to secure the flow rate of oil discharged from pump house 20, leading to restrained abrupt pressure rise within pump house 20. Therefore, a loss of driving horsepower due to pressure rise within pump house 20 will not occur.

In the illustrative embodiment, particularly, channel 23*c* extends to the vicinity of tooth bottom 19*a* of outer rotor 19 to which oil is driven by centrifugal force during pump rotation. Moreover, channel 23*c* is larger in sectional area than channels 23*a*, 23*b*. Those features allow smooth oil flow from pump house 20 to discharge chamber 13 at low/medium-speed rotation of the pump.

As described above, in the illustrative embodiment, the flow resistances of channels 23*a*, 23*b*, 23*c* are increased by decreasing the sectional area or enlarging the length, obtaining characteristic (C) in FIG. 11 at high-speed rotation of the pump. This allows achievement of sufficiently small pressure difference $\Delta P_1$ at the instant when pump house 20 opens in channels 23*a*, 23*b*, 23*c*. Moreover, the total sectional area of channels is increased by increasing the number thereof, allowing a reduction in horsepower at low/medium-speed rotation of the pump as illustrated by characteristic (E) in FIG. 12.

Figure 7:
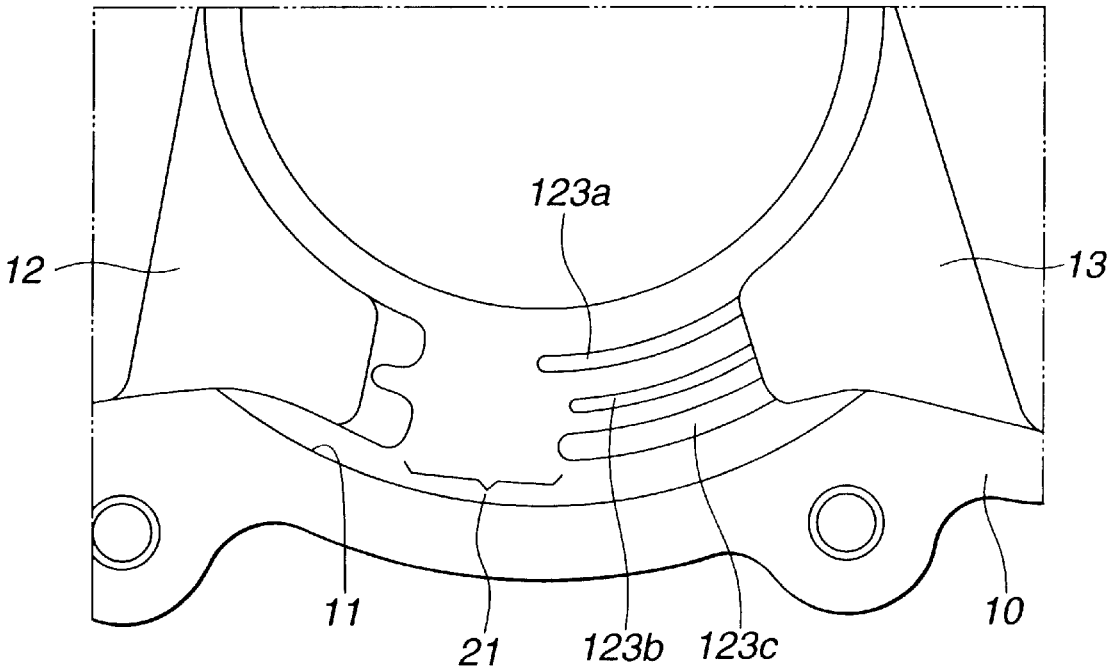
FIG. 7 is a view similar to FIG. 3, showing another embodiment of the present invention.
Figure 8:
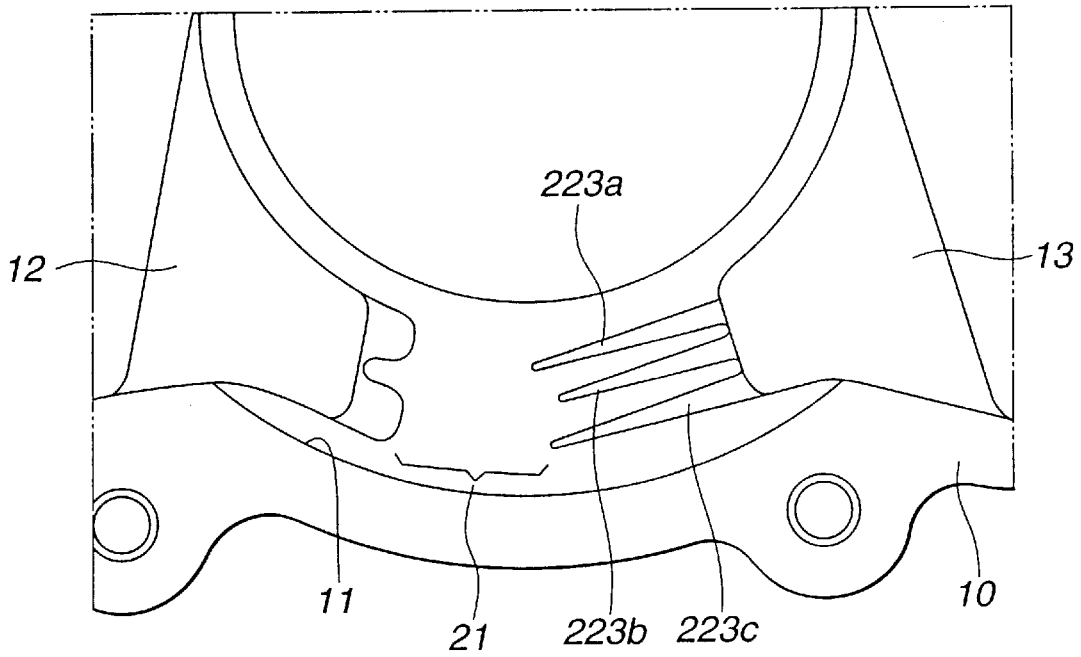
FIG. 8 is a view similar to FIG. 7, showing a further embodiment of the present invention.

Having described the present invention with regard to the preferred embodiment, it is noted that the present invention is not limited thereto, and various changes and modifications can be made without departing from the scope of the present invention. By way of example, referring to FIG. 7, channels 123*a*, 123*b*, 123*c* may be formed circularly instead of being formed linearly, or referring to FIG. 8, channels 223*a*, 223*b*, 223*c* may be formed to have a tapered tip. The embodiment as shown in FIG. 7 allows more smooth oil flow, whereas the embodiment as shown in FIG. 8 allows gradual increase in flow rate of oil discharged from pump house 20 to discharge chamber 13.

Moreover, in the above embodiments, maximum-volume-side partition area 21 is arranged in the vicinity of a position where pump house 20 has a maximum volume actually. Alternatively, in a pump used mainly at high-speed rotation, maximum-volume-side partition area 21 may be arranged closer to discharge chamber 13. Further, channels 23*a*, 23*b*, 23*c* may be formed in both the main body and the cover of housing 10, or in only the cover thereof.

Furthermore, in the above embodiments, the pump main body includes a trochoidal pump mechanism. Optionally, the pump main body can include other pump mechanisms such as vane pump on condition that a plurality of circumferentially-arranged pump houses are urged to move in the direction of rotation for variation in the volume thereof. Further, all channels can be of the same sectional area.

The entire teachings of Japanese Patent Application 2000-341375 are incorporated herein by reference.

What is claimed is:

1. An oil pump, comprising:

a housing;

a pump portion accommodated in the housing, the pump portion being rotated with both sides closed by sidewalls of the housing, the pump portion including a plurality of pump houses arranged circumferentially, the pump houses being urged to move in a direction of rotation for variation in a volume thereof, the pump portion comprising an inner rotor and an outer rotor disposed eccentrically and having trochoid-curve-based external teeth and internal teeth, respectively, wherein the inner and outer rotors cooperate to define the plurality of pump houses, and wherein the number of the internal teeth is larger by one than that of the external teeth;

suction and discharge chambers formed in the sidewall of the housing, the suction and discharge chambers facing suction and discharge areas of the pump portion, respectively;

a maximum-volume-side partition area formed with the sidewall of the housing on a trajectory of the pump houses and at a position where each pump house has a maximum volume, wherein the maximum-volume-side partition area creates a section where any pump house fails to spread over either of the suction and discharge chambers; and three channels arranged in the discharge chamber at an end thereof, each channel having a predetermined length and extending to the partition area, wherein the first channel extends to a position in the maximum-volume-side partition area into which a contact of the inner and outer rotors at tooth tips thereof is urged to move, the second channel extend to a position in the maximum-volume-side partition area into which a tooth bottom of the inner rotor is urged to move, and the third channel extends to a position in the maximum-volume-side partition area into which a tooth bottom of the outer rotor is urged to move.

2. The oil pump as claimed in claim 1, wherein the first and second channels are smaller in sectional area than the third channel.

3. The oil pump as claimed in claim 1, wherein the pump portion comprises an inner rotor and an outer rotor disposed eccentrically and having trochoid-curve-based external teeth and internal teeth, respectively, wherein the inner and outer rotors cooperate to define the plurality of pump houses, and wherein the number of the internal teeth is larger by one than that of the external teeth.

4. The oil pump as claimed in claim 1, wherein at least one of the first and second channels is greater in flow resistance than the third channel.

5. The oil pump as claimed in claim 1, wherein the channels have a section shaped like a rectangle.

6. The oil pump as claimed in claim 1, wherein the channels have a section shaped like a semicircle.

7. The oil pump as claimed in claim 1, wherein the channels have a section shaped like a triangle.

8. The oil pump as claimed in claim 1, wherein the channels extend linearly.

9. The oil pump as claimed in claim 1, wherein the channels extend circularly.

10. The oil pump as claimed in claim 1, wherein the channels have a tapered tip.

11. The oil pump as claimed in claim 1, wherein the housing comprises a main-body portion, wherein the sidewalls of the housing comprise inner walls of the main-body portion, and wherein each channel is formed in the main-body portion.

12. The oil pump as claimed in claim 1, wherein the channels are obtained by means of aluminum die-casting.

13. The oil pump as claimed in claim 1, wherein the channels are obtained by means of machining.

14. An oil pump, comprising:

a housing;

a pump portion accommodated in the housing, the pump portion being rotated with both sides closed by sidewalls of the housing, the pump portion including a plurality of pump houses arranged circumferentially, the pump houses being urged to move in a direction of rotation for variation in a volume thereof;

suction and discharge chambers formed in the sidewall of the housing, the suction and discharge chambers facing suction and discharge areas of the pump portion, respectively;

a maximum-volume-side partition area formed with the sidewall of the housing on a trajectory of the pump houses and at a position where each pump house has a maximum volume, wherein the maximum-volume-side partition area creates a section where any pump house fails to spread over either of the suction and discharge chambers; and means for defining a plurality of channels in the discharge chamber at an end thereof, each channel having a predetermined length and extending to the maximum-volume-side partition area;

wherein the plurality of channels includes first, second and third channels; and wherein the first and second channels are smaller in sectional area than the third channel.

* * * * *